US010876411B2

(12) United States Patent
Ramirez

(10) Patent No.: US 10,876,411 B2
(45) Date of Patent: Dec. 29, 2020

(54) NON-AXISYMMETRIC END WALL CONTOURING WITH FORWARD MID-PASSAGE PEAK

(71) Applicant: United Technologies Corporation, Farmington, CT (US)

(72) Inventor: Loubriel Ramirez, San Antonio, PR (US)

(73) Assignee: United Technologies Corporation, Farmington, CT (US)

( * ) Notice: Subject to any disclaimer, the term of this patent is extended or adjusted under 35 U.S.C. 154(b) by 37 days.

(21) Appl. No.: 16/378,161

(22) Filed: Apr. 8, 2019

(65) Prior Publication Data

US 2020/0318484 A1 Oct. 8, 2020

(51) Int. Cl.
*F01D 5/14* (2006.01)

(52) U.S. Cl.
CPC ..... *F01D 5/143* (2013.01); *F05D 2250/73* (2013.01)

(58) Field of Classification Search
CPC ..... F01D 5/143; F01D 17/162
See application file for complete search history.

(56) References Cited

U.S. PATENT DOCUMENTS 4,170,874 A * 10/1979 Kyrklund ..... F01D 5/142 415/160
4,677,828 A * 7/1987 Matthews ..... F01D 5/143 415/914
6,213,711 B1 * 4/2001 Muller ..... F01D 5/145 415/191

(Continued)

FOREIGN PATENT DOCUMENTS

EP 3064706 A1 9/2016
EP 3219914 A1 * 9/2017 ..... F01D 5/143

(Continued)

OTHER PUBLICATIONS

MrBrushy. Aviation Stack Exchange "Why should the leading edge be blunt on low-speed subsonic airfoils?" posted Apr. 13, 2016, edited Sep. 19, 2018, accessed from https://aviation.stackexchange.com/questions/26532/why-should-the-leading-edge-be-blunt-on-low-speed-subsonic-airfoils (Year: 2018).*

(Continued)

*Primary Examiner* — Michael Lebentritt
*Assistant Examiner* — Topaz L. Elliott
(74) *Attorney, Agent, or Firm* — Kinney & Lange, P.A.

(57) ABSTRACT

A turbine section includes a pair of adjacent turbine airfoils and an endwall extending between the airfoils. The endwall includes a first feature spanning approximately twenty percent pitch and having a first depression with a first maximum depression located between twenty percent and sixty percent of an axial chord length of the first airfoil, a second feature adjacent the first feature with the second feature spanning approximately forty percent pitch and having a first peak with a maximum height located between twenty percent and sixty percent of the axial chord length of the first airfoil, and a third feature adjacent the second feature and first side of the second airfoil with the third feature spanning approximately forty percent pitch and having a second depression with a second maximum depression located between thirty percent and sixty percent of an axial chord length of the second airfoil.

20 Claims, 3 Drawing Sheets

(56) References Cited

U.S. PATENT DOCUMENTS

| | | | | |
|---|---|---|---|---|
| 7,354,243 | B2 | 4/2008 | Harvey | |
| 8,177,499 | B2 * | 5/2012 | Iida | F01D 9/041 415/208.1 |
| 8,807,930 | B2 * | 8/2014 | Green | F01D 5/143 415/191 |
| 9,200,638 | B2 | 12/2015 | Boston et al. | |
| 9,518,467 | B2 | 12/2016 | Guimbard et al. | |
| 9,745,850 | B2 * | 8/2017 | Guendogdu | F01D 5/143 |
| 9,822,795 | B2 | 11/2017 | Johann et al. | |
| 10,041,353 | B2 * | 8/2018 | Gier | F01D 5/145 |
| 10,161,255 | B2 | 12/2018 | Brozyna et al. | |
| 10,196,897 | B2 | 2/2019 | Thomas | |
| 10,344,601 | B2 * | 7/2019 | Turner | F01D 5/145 |
| 10,508,550 | B2 * | 12/2019 | Nash | F01D 5/145 |
| 2010/0303627 | A1 * | 12/2010 | Megerle | F01D 5/145 416/179 |
| 2012/0251312 | A1 | 10/2012 | Johann et al. | |
| 2013/0108433 | A1 * | 5/2013 | Green | F01D 5/143 415/208.2 |
| 2014/0348660 | A1 * | 11/2014 | Guendogdu | F01D 5/145 416/242 |
| 2015/0044038 | A1 * | 2/2015 | Gier | F01D 5/142 415/192 |
| 2015/0204201 | A1 * | 7/2015 | Turner | F01D 11/008 416/179 |
| 2016/0245299 | A1 | 8/2016 | Cellier | |
| 2018/0328184 | A1 | 11/2018 | Brettschneider et al. | |
| 2019/0120059 | A1 * | 4/2019 | Nash | F01D 5/143 |
| 2019/0323355 | A1 * | 10/2019 | Shahpar | F23R 3/002 |

FOREIGN PATENT DOCUMENTS

| | | | |
|---|---|---|---|
| JP | 2009209745 | A | 9/2009 |
| WO | WO2014028056 | A1 | 2/2014 |

OTHER PUBLICATIONS

Extended European Search Report for EP Application No. 20156223.8, dated Aug. 20, 2020, 7 pages.

Extended European Search Report for EP Application No. 20156236.0, dated Aug. 21, 2020, 7 pages.

* cited by examiner

NON-AXISYMMETRIC END WALL CONTOURING WITH FORWARD MID-PASSAGE PEAK

STATEMENT OF GOVERNMENT INTEREST

This invention was made with government support under Contract Number W911W6-16-2-0012 awarded by the United States Army. The government has certain rights in the invention.

BACKGROUND

The present disclosure relates to turbine airfoils in a gas turbine engine and, more particularly, to airfoils with non-axisymmetric endwall contouring with a forward mid-passage peak.

Gas turbine engines typically include a compressor section, a combustor section, and a turbine section, with an annular flow path extending axially through each. Initially, air flows through the compressor section where it is compressed or pressurized. The combustors in the combustor section then mix and ignite the compressed air with fuel, generating hot combustion gas. These hot combustion gases are then directed by the combustors to the turbine section where power is extracted from the hot gases by causing turbine blades to rotate.

Some sections of the engine include airfoil assemblies comprising airfoils (typically blades/rotors or vanes/stators) mounted at one or both ends to an endwall. Air within the gas turbine engine moves through fluid flow passages in the airfoil assemblies. The fluid flow passages are defined by adjacent airfoils extending between concentric endwalls. Near the endwalls, the fluid flow is adversely impacted by a flow phenomenon known as a vortex, which forms as a result of the boundary layer separating from the endwall as the gas passes the airfoils. The separated gas reorganizes into the vortex, and this loss is referred to as secondary or endwall loss. Accordingly, there exists a need for a way to mitigate or reduce these endwall losses.

SUMMARY

A turbine section includes a pair of adjacent turbine airfoils and an endwall extending between the airfoils. The endwall includes a first feature spanning approximately twenty percent pitch and having a first depression with a first maximum depression located between twenty percent and sixty percent of an axial chord length of the first airfoil, a second feature adjacent the first feature with the second feature spanning approximately forty percent pitch and having a first peak with a maximum height located between twenty percent and sixty percent of the axial chord length of the first airfoil, and a third feature adjacent the second feature and first side of the second airfoil with the third feature spanning approximately forty percent pitch and having a second depression with a second maximum depression located between thirty percent and sixty percent of an axial chord length of the second airfoil.

A gas turbine engine having a variable speed power turbine includes an annular turbine stage; a plurality of airfoils within the annular turbine stage and each having a first side, a second side, a leading edge, a trailing edge with the plurality of airfoils having a first airfoil and a second airfoil; and an endwall extending between the second side of the first airfoil and the first side of the second airfoil. The endwall includes a first feature adjacent the second side of the first airfoil between the leading edge and the trailing edge with the first feature spanning approximately twenty percent pitch as measured from the second side of the first airfoil and having a first depression with a first maximum depression located between twenty percent and sixty percent of an axial chord length of the first airfoil, a second feature adjacent the first feature between the leading edge and the trailing edge with the second feature spanning approximately forty percent pitch as measured from the second side of the first airfoil and having a first peak with a maximum height located between twenty percent and sixty percent of the axial chord length of the first airfoil, and a third feature adjacent the second feature and first side of the second airfoil between the leading edge and the trailing edge with the third feature spanning approximately forty percent pitch as measured from the second side of the first airfoil and having a second depression with a second maximum depression located between thirty percent and sixty percent of the axial chord length of the first airfoil.

DETAILED DESCRIPTION

A turbine section in a variable speed power turbine includes at least a pair of airfoils and an endwall therebetween. The endwall is contoured to reduce endwall losses resulting from a vortex that forms within the fluid flow passage between airfoils. The endwall is contoured to include at least three features with two being depressions (as compared to a consistently arced, smooth endwall) and one being a peak. The three features are positioned to provide maximum reduction in endwall losses. The endwall contouring can be located on an inner diameter endwall (extending between radially inner ends of the airfoils) or an outer diameter endwall (extending between radially outer ends of the airfoils).

Figure 1:
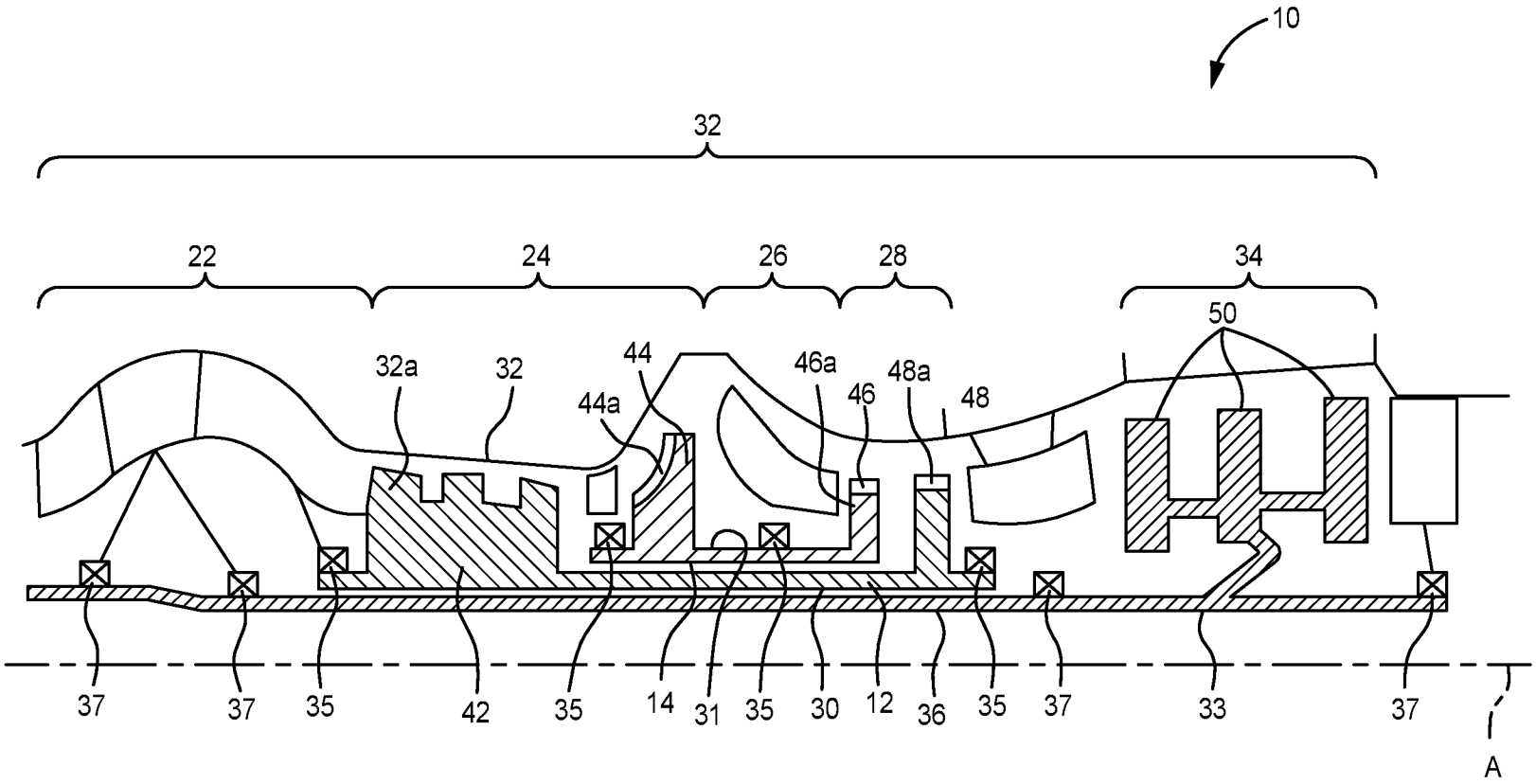
FIG. 1 is a schematic of a gas turbine engine.

FIG. 1 is a schematic of a gas turbine engine 10. In this embodiment, gas turbine engine 10 is a three-spool turboshaft engine with low spool 12, high spool 14, and power turbine spool 33 mounted for rotation about engine centerline A. Gas turbine engine 10 includes inlet duct section 22, compressor section 24, combustor section 26, turbine section 28, and power turbine section 34.

Compressor section 24 includes low pressure compressor 42 with a multitude of circumferentially-spaced blades 42*a* and centrifugal high pressure compressor 44 with a multitude of circumferentially-spaced blades 44*a*. Turbine section 28 includes high pressure turbine 46 with a multitude of circumferentially-spaced turbine blades 46*a* and low pressure turbine 48 with a multitude of circumferentially-spaced blades 48*a*. Power turbine section 34 includes a multitude of circumferentially-spaced blades 50. Low spool 12 includes inner shaft 30 that interconnects low pressure compressor 42 and low pressure turbine 48. High spool 14 includes outer shaft 31 that interconnects high pressure compressor 44 and high pressure turbine 46.

Low spool 12 and high spool 14 are mounted for rotation about engine centerline A relative to engine static structure 32 via several bearing systems 35. Power turbine spool 33 is mounted for rotation about the engine centerline A relative to engine static structure 32 via several bearing systems 37.

Compressor section 24 and turbine section 28 drive power turbine section 34 that drives output shaft 36. In this example engine, compressor section 24 has five stages, turbine section 28 has two stages and power turbine section 34 has three stages. During operation, compressor section 24 draws air through inlet duct section 22. In this example, inlet duct section 22 opens radially relative to centerline A. Compressor section 24 compresses the air, and the compressed air is then mixed with fuel and burned in combustor section 26 to form a high pressure, hot gas stream. The hot gas stream is expanded in turbine section 28 which rotationally drives compressor section 24. The hot gas stream exiting turbine section 28 further expands and drives power turbine section 34 and output shaft 36. Compressor section 24, combustor section 26, and turbine section 28 are often referred to as the gas generator, while power turbine section 34 and output shaft 36 are referred to as the power section. The gas generator section generates the hot expanding gases to drive the power section. Depending on the design, the engine accessories may be driven either by the gas generator or by the power section. Typically, the gas generator section and power section are mechanically separate such that each rotate at different speeds appropriate for the conditions, referred to as a "free power turbine."

Figure 2A:
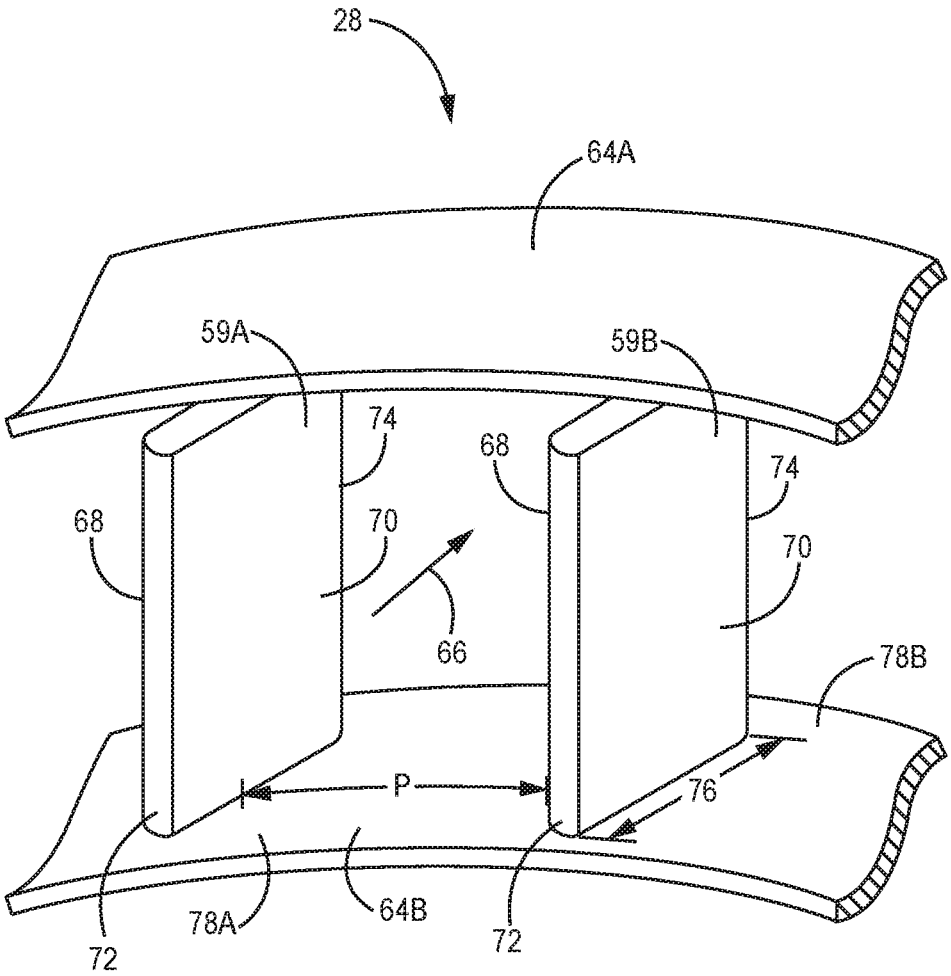
FIG. 2A is perspective view of a pair of adjacent power turbine airfoils with a corresponding endwall.
Figure 2B:
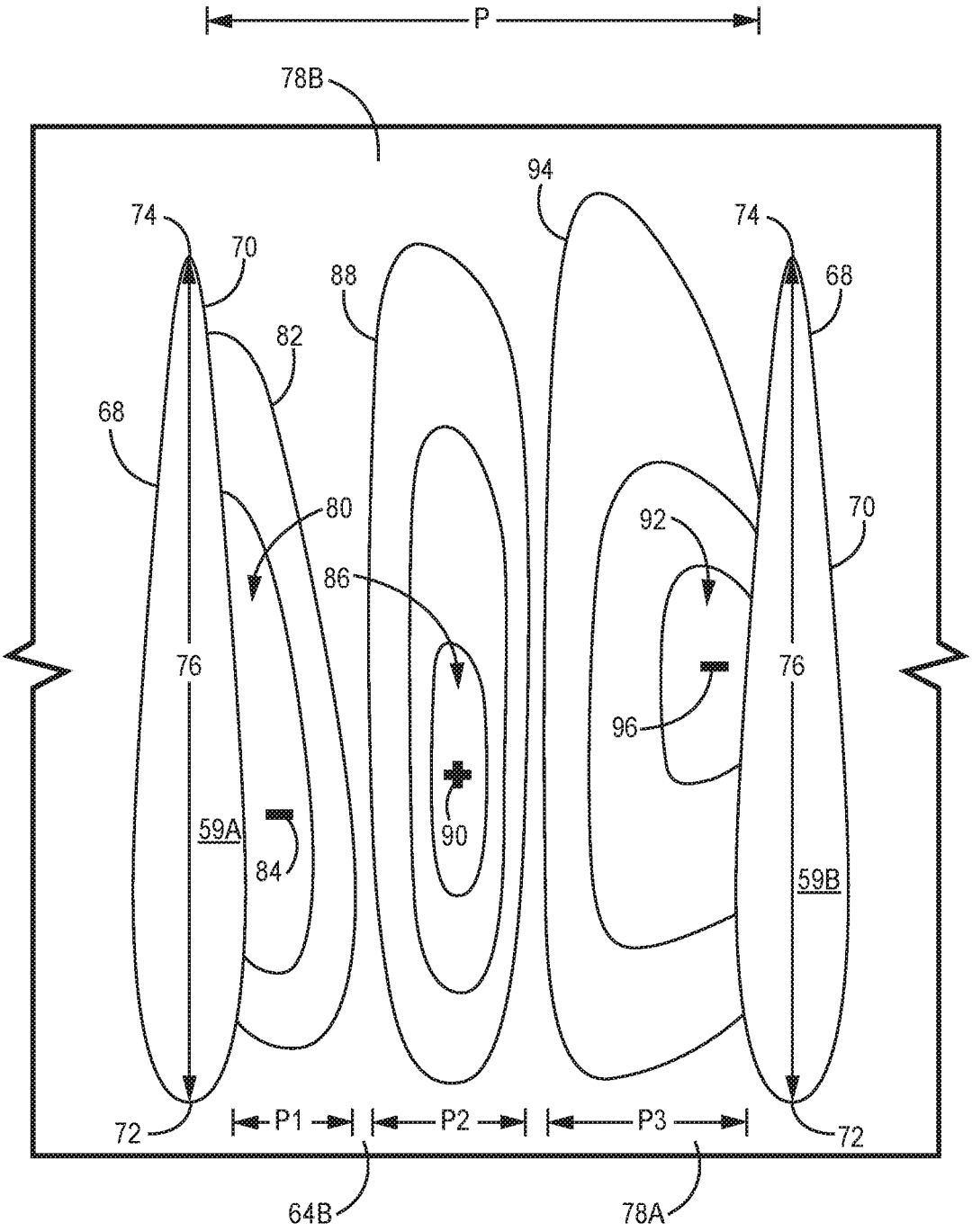
FIG. 2B is a plan view of a non-axisymmetric endwall having a forward mid-passage peak.

FIG. 2A is a perspective view of a pair of adjacent airfoils 59 within turbine section 28 or power turbine section 34 of gas turbine engine 10, and FIG. 2B is a plan view of airfoils 59 with corresponding inner endwall 64B. Airfoils 59 (first airfoil 59A and second airfoil 59B) extending radially between outer endwall 64A and inner endwall 64B and defining a fluid flow passage 66 therebetween. First airfoil 59A and second airfoil 59B are similar in configuration and both include first side 68, second side 70, leading edge 72, trailing edge 74, and axial chord length 76. Inner endwall 64B includes pitch P, axially upstream end 78A, axially downstream end 78B, first feature 80, second feature 86, and third feature 92. First feature 80 includes first depression 82 having first maximum depression 84 (i.e., a point of maximum depth) and first pitch P1. Second feature 86 includes first peak 88 having maximum height 90 and second pitch P2. Third feature 92 includes second depression 94 having second maximum depression 96 (i.e., a point of maximum depth) and third pitch P3.

Airfoils 59 can be within turbine section 28 and can be blades/rotors 46*a* or 46*b* or vanes/stators, and/or airfoils 59 can be within power turbine section 34 and can be blades/rotors 50 or vanes/stators. The endwall contouring of inner endwall 64B may be particularly well suited for use in a variable speed power turbine. Power turbine section 34 is annular in shape with endwalls 64A and 64B extending circumferentially to form two concentric rings centered about centerline A with airfoils 59 extending radially between endwalls 64A and 64B. While FIGS. 2A and 2B show only two airfoils 59, turbine section 28/power turbine section 34 often includes more than two airfoils 59 equally spaced around the annular section. In the disclosed embodiment, the configuration of airfoils 59 repeats with inner endwall 64B having the same configuration between adjacent airfoils 59. Additionally, while power turbine section 34 is described as having inner endwall 64B with features 80, 86, and 92, other embodiments/configurations can include outer endwall 64A with similar features to features 80, 86, and 92 such that both outer and inner endwalls 64A and 64B include endwall contouring or only outer endwall 64A includes endwall contouring. While described below as extending to a right of first airfoil 59A (when looking downstream at airfoil 59), outer endwall 64A and inner endwall 64B with features 80, 86, and 92 can extend to a left side of first airfoil 59A such that features 80, 86, and 92 have a configuration that is mirrored to the configuration of features 80, 86, and 92 described below.

Airfoils 59 can be blades (i.e., part of a rotor assembly) or vanes (i.e., part of a stator assembly) that are fixed only at a radially inner end to inner endwall 64B (as shown in FIG. 2A), fixed only at a radially outer end to outer endwall 64A, or fixed to both outer endwall 64A and inner endwall 64B such that airfoils 59 extend entirely across fluid flow passage 66. Airfoils 59 can be incident tolerant airfoils. Airfoils 59 include first airfoil 59A and second airfoil 59B that are similar in configuration. However, other embodiments can include differently shaped/configured first airfoil 59A and second airfoil 59B depending on the design of gas turbine engine 10. Unless otherwise noted, when describing the components of airfoils 59, the components of airfoils 59 are found on both first airfoil 59A and second airfoil 59B. Thus, first airfoil 59A and second airfoil 59B may be referred to as airfoil 59.

Airfoil 59 includes first side 68, which is on a left side of airfoil 59 in FIGS. 2A and 2B (i.e., is on a left side when looking downstream at airfoil 59), and second side 70, which is on a right side. First sides 68 and second side 70 can each be either a pressure side or a suction side of airfoil 59. In an exemplary embedment, first side 68 is the suction side and second side 70 is the pressure side. Airfoil 59 includes leading edge 72 at an axially upstream edge and trailing edge 74 at an axially downstream edge with axial chord length 76 extending therebetween to represent a length of airfoil 59. In FIGS. 2A and 2B, axial chord length 76 extends entirely in an axial direction because airfoil 59 is shown as extending entirely in the axial direction. However, other configurations can have airfoil 59 angled and or arced such that axial chord length 76 extends at least partially in a circumferential direction.

Outer endwall 64A is radially outward from airfoils 59 and extends between airfoils 59, while inner endwall 64B is radially inward from airfoils 59 and extend between airfoils 59. FIGS. 2A and 2B show only a segment of outer endwall 64A and inner endwall 64B with a complete outer endwall 64A and inner endwall 64B being annular in shape (i.e., extending circumferentially to form two concentric rings centered about centerline A). While described as features 80, 86, and 92 being located on/in inner endwall 64A, outer endwall 64B can include features 80, 86, and/or 92 with first depression 82 and second depression 94 being indentations that extend radially outward (so a depression in outer endwall 64A) and first peak 88 being a bulge that extends radially inward into fluid flow passage 66. Both outer endwall 64A and inner endwall 64B have axially upstream end 78A that extends axially forward of airfoils 59 and axially downstream end 78B that extends axially rearward of airfoils 59. However, other configurations can include endwalls that extend upstream and downstream only to leading edge 72 and trailing edge 74 (i.e., the endwalls do not extend forward of leading edge 72 or rearward of trailing edge 74 and terminate at leading edge 72 and trailing edge 74, respectively).

Inner endwall 64B extends circumferentially between first airfoil 59A and second airfoil 59B a distance denoted as pitch P. Pitch P is a circumferential length along inner endwall 64B between airfoils 59. Features 80, 86, and 92 can be located at various percentages of pitch P (with zero percent being adjacent second side 70 of first airfoil 59A and one-hundred percent being adjacent first side 68 of second airfoil 59B). Features 80, 86, and 92 can have a circumferential width that is measured as a percentage of the total length of pitch P. For example, first feature 80 has pitch P1 that is approximately twenty percent, which means a circumferential width of first feature 80 is twenty percent of the total distance between airfoils 59 (or twenty percent of pitch P). An axial length and location of features 80, 86, and 92 are measured relative to axial chord length 76 of airfoils 59. For example, first feature 80 has first depression 82 with first maximum depression 84 located between approximately twenty percent and approximately sixty percent of axial chord length 76, which means that first maximum depression 84 is located between a point that is approximately twenty percent of the total distance of axial chord length 76 and a point that is approximately sixty percent of the total distance of axial chord length 76.

The heights and depths of first feature 80, second feature 86, and third feature 92 are compared to an arc extending between a point where first airfoil 59A contacts inner endwall 64B and a point where second airfoil 59B contacts inner endwall 64B. The arc is a segment of a circle that conforms to inner endwall 64B and is centered about engine centerline A. Thus, a "flat" portion of inner endwall 64B is not actually flat, but rather is a portion that follows the arced segment between first airfoil 59A and second airfoil 59B. For inner endwall 64B, a "bulged" portion is a portion that is radially outward from the arc (if inner endwall 64B were to continue along the arc without the bulged portion), and a "depression" is a portion that is radially inward from the arc (if inner endwall 64B were to continue along the arc without the depression). However, if the endwall contouring is applied to outer endwall 64A, a bulged portion would be a feature that extends into fluid flow passage 66 and a depression is a feature that extends away from fluid flow passage 66 (i.e., radially outward from the arc).

First feature 80 is adjacent second side 70 of first airfoil 59A and is axially located between leading edge 72 and trailing edge 74. First feature 80 includes first pitch P1 with a span (i.e., a circumferential width) that is approximately twenty percent pitch. First feature 80 has first depression 82 with first maximum depression 84 (i.e., a point of maximum depth) located between approximately twenty and sixty percent of axial chord length 76 of first airfoil 59A. In the exemplary embodiment, first maximum depression 84 is located between approximately thirty-five and forty-five percent of axial chord length 76 of first airfoil 59A. First depression 82 is an indentation as measured from inner endwall 64B if inner endwall 64B followed the consistent arc along pitch P (due to inner endwall 64B being annular in shape). First maximum depression 84 can have any depth, including a depth that is approximately five percent of airfoil chord length 76. First depression 82 slopes (e.g., is concave) to first maximum depression 84, with the slope having any angle that is constant or varying. First maximum depression 84 can be relatively large (e.g., first maximum depression 84 is an oblong shape having multiple points at the same depth) or small (e.g., first maximum depression 84 is a point/small circle). First maximum depression 84 can be adjacent first airfoil 59A (as shown in FIG. 2B) or distant from first airfoil 59A. First feature 80 can include other depressions or features for reducing endwall losses.

Second feature 86 is adjacent first feature 80 and is axially located substantially between leading edge 72 and trailing edge 74. Second feature includes second pitch P2 with a span (i.e., a circumferential width) that is approximately forty percent pitch. Second feature 86 has first peak 88 with maximum height 90 located between approximately twenty and sixty percent of axial chord length 76 of first airfoil 59A. In the exemplary embodiment, maximum height 90 is located between approximately thirty-five and forty-five percent of axial chord length 76 of first airfoil 59A. Second feature 86 is substantially axially located between leading edge 72 and trailing edge 74, but a portion of second feature 86 can extend axially rearward of trailing edge 74 of first airfoil 59A. First peak 88 is a bulge as measured from inner endwall 64B if inner endwall 64B followed the consistent arc along pitch P (due to inner endwall 64B being annular in shape). Maximum height 90 can have any height, including a height that is approximately five percent of axial chord length 76. First peak 88 slopes (e.g., is convex) radially outward to maximum height 90, with the slope having any angle that is constant or varying. Maximum height 90 can be relatively large (e.g., maximum height 90 is a plateau having an oblong shape with multiple points at the same height) or small (e.g., maximum 90 is a point/small circle). Second feature 86 can be in contact with first feature 80 (e.g., the slope of first depression 82 continues radially outward to form the slope of first peak 88) or, as shown in FIG. 2B, second features 86 can be distant from first feature 80 with a flat portion (i.e., following the arc) of inner endwall 64B therebetween. Second feature 86 can include other peaks or features for reducing endwall losses. Generally, second feature 86 with first peak 88 is closer to upstream end 78A than downstream end 78B of inner endwall 64B.

Third feature 92 is adjacent to and between second feature 86 and first side 68 of second airfoil 59B and is axially located substantially between leading edge 72 and trailing edge 74. Third feature 92 includes third pitch P3 with a span (i.e., a circumferential width) that is approximately forty percent pitch. Third feature 92 has second depression 94 with second maximum depression 96 (i.e., a point of maximum depth) located between approximately thirty and sixty percent of axial chord length 76 of second airfoil 59B. In the exemplary embodiment, second maximum depression 96 is located between approximately forty-five and fifty-five percent of axial chord length 76 of second airfoil 59B. Second depression 94 is an indentation as measured from inner endwall 64B if inner endwall 64 followed the consistent arc along pitch P (due to inner endwall 64B being annular in shape). Second depression 94 can have any depth, including a depth that is approximately five percent of airfoil chord length 76. Third feature 92 is substantially axially located between leading edge 72 and trailing edge 74, but a portion of third feature 92 can extend axially rearward of trailing edge 74 of second airfoil 59B. Second depression 94 slopes (e.g., is concave) to second maximum depression 96, with the slope having any angle that is constant or varying. Second maximum depression 96 can be any depth, including a depth that is equal to the depth of first maximum depression 84. Additionally, second maximum depression 96 can be relatively large (e.g., second maximum depression 96 is an oblong shape having multiple points at the same depth) or small (e.g., second maximum depression 96 is a point/small circle). Third feature 92 can be in contact with second feature 86 (e.g., the slope of first peak 88 continues radially inward to form the slope of second depression 96), or, as shown in FIG. 2B, third feature 92 can be distant from second feature 86 with a flat portion (i.e., following the arc) of inner endwall 64B therebetween. Second maximum depression 96 can be adjacent second airfoil 59B (as shown in FIG. 2B) or distant from second airfoil 59B. Third feature 92 can include other depressions or features for reducing endwall losses.

Features 80, 86, and 92 can be circumferentially located relative to one another such that first pitch P1 of first feature 80 spans from approximately zero percent pitch P to approximately twenty percent pitch P, second pitch P2 of second feature 86 spans from approximately twenty percent pitch P to approximately sixty percent pitch P, and third pitch P2 of third feature 92 spans from approximately sixty percent pitch P to approximately one-hundred percent pitch P as measured from second side 70 of first airfoil 59A.

Turbine section/stage 28 and/or power turbine section 34 in variable speed power turbine engine 10 includes at least a pair of airfoils 59 and endwalls 64A and 64B therebetween. Endwalls 64A and/or 64B can be contoured to reduce endwall losses resulting from a vortex that forms within fluid flow passage 66 between airfoils 59. Endwalls 64A and 64B can be contoured to include at three features 80, 86, and 92 with first feature 80 and third feature 92 being depressions and second feature 86 being a peak. The three features 80, 86, and 92 are positioned to provide maximum reduction in endwall losses. The endwall contouring can be located on inner diameter endwall 64B (extending between radially inner ends of the airfoils) or outer diameter endwall 64A (extending between radially outer ends of the airfoils).

Discussion of Possible Embodiments

The following are non-exclusive descriptions of possible embodiments of the present invention.

A turbine section includes a pair of adjacent turbine airfoils and an endwall extending between the airfoils. The endwall includes a first feature spanning approximately twenty percent pitch and having a first depression with a first maximum depression located between twenty percent and sixty percent of an axial chord length of the first airfoil, a second feature adjacent the first feature with the second feature spanning approximately forty percent pitch and having a first peak with a maximum height located between twenty percent and sixty percent of the axial chord length of the first airfoil, and a third feature adjacent the second feature and first side of the second airfoil with the third feature spanning approximately forty percent pitch and having a second depression with a second maximum depression located between thirty percent and sixty percent of an axial chord length of the second airfoil.

The turbine section of the preceding paragraph can optionally include, additionally and/or alternatively, any one or more of the following features, configurations and/or additional components:

The turbine section is a power turbine section.

The pair of airfoils are incident tolerant airfoils.

The first side of the pair of airfoils is a suction side and the second side of the pair of airfoils is a pressure side.

The first maximum depression is located between thirty-five and forty-five percent of the axial chord length of the first airfoil.

The maximum height of the first peak is located between thirty-five and forty-five percent of the axial chord length of the first airfoil.

The second maximum depression is located between forty-five and fifty-five percent of the axial chord length of the second airfoil.

The endwall extends between an inner diameter of the pair of airfoils.

At least a portion of the third feature extends axially rearward of the trailing edge of the second airfoil.

The pair of airfoils are turbine blades.

The second feature spans from approximately twenty percent to approximately sixty percent pitch as measured from the second side of the first airfoil and the third feature spans from approximately sixty percent to approximately one-hundred percent pitch as measured from the second side of the first airfoil.

A gas turbine engine having a variable speed power turbine includes an annular turbine stage; a plurality of airfoils within the annular turbine stage and each having a first side, a second side, a leading edge, a trailing edge with the plurality of airfoils having a first airfoil and a second airfoil; and an endwall extending between the second side of the first airfoil and the first side of the second airfoil. The endwall includes a first feature adjacent the second side of the first airfoil between the leading edge and the trailing edge with the first feature spanning approximately twenty percent pitch as measured from the second side of the first airfoil and having a first depression with a first maximum depression located between twenty percent and sixty percent of an axial chord length of the first airfoil, a second feature adjacent the first feature between the leading edge and the trailing edge with the second feature spanning approximately forty percent pitch as measured from the second side of the first airfoil and having a first peak with a maximum height located between twenty percent and sixty percent of the axial chord length of the first airfoil, and a third feature adjacent the second feature and first side of the second airfoil between the leading edge and the trailing edge with the third feature spanning approximately forty percent pitch as measured from the second side of the first airfoil and having a second depression with a second maximum depression located between thirty percent and sixty percent of the axial chord length of the first airfoil.

The gas turbine engine of the preceding paragraph can optionally include, additionally and/or alternatively, any one or more of the following features, configurations and/or additional components:

The plurality of airfoils are incident tolerant airfoils.

The first side of the plurality of airfoils is a pressure side and the second side of the plurality of airfoils is a suction side.

The first maximum depression is located between thirty-five and forty-five percent of the axial chord length of the first airfoil.

The maximum height of the first peak is located between thirty-five and forty-five percent of the axial chord length of the first airfoil.

The second maximum depression is located between forty-five and fifty-five percent of the axial chord length of the first airfoil.

The endwall extends between an inner diameter of the plurality of airfoils.

At least a portion of the third feature extends axially rearward of the trailing edge of the first airfoil.

The plurality of airfoils are turbine rotors.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A turbine section comprising:

a pair of adjacent turbine airfoils, each airfoil including a first side, a second side, a leading edge, a trailing edge, and an axial chord length extending between the leading edge and the trailing edge, the pair of turbine airfoils having a first airfoil and a second airfoil; and an endwall extending between the second side of the first airfoil and the first side of the second airfoil, the endwall comprising:

a first feature adjacent the second side of the first airfoil between the leading edge and the trailing edge, the first feature spanning twenty percent pitch and having a first depression with a first maximum depression located only between twenty percent and sixty percent of the axial chord length of the first airfoil;

a second feature adjacent the first feature between the leading edge and the trailing edge of the first airfoil, the second feature spanning forty percent pitch and having a first peak with a maximum height located only between thirty-five percent and forty-five percent of the axial chord length of the first airfoil; and a third feature adjacent the second feature and the first side of the second airfoil between the leading edge and the trailing edge, the third feature spanning forty percent pitch and having a second depression with a second maximum depression located only between thirty percent and sixty percent of the axial chord length of the second airfoil.

2. The turbine section of claim 1, wherein the turbine section is a power turbine section.

3. The turbine section of claim 1, wherein the pair of airfoils are incident tolerant airfoils.

4. The turbine section of claim 1, wherein the first side of each of the pair of airfoils is a suction side and the second side of each of the pair of airfoils is a pressure side.

5. The turbine section of claim 1, wherein the first maximum depression is located between thirty-five and forty-five percent of the axial chord length of the first airfoil.

6. The turbine section of claim 1, wherein the second maximum depression is located between forty-five and fifty-five percent of the axial chord length of the second airfoil.

7. The turbine section of claim 1, wherein the endwall extends between an inner diameter of the pair of airfoils.

8. The turbine section of claim 1, wherein at least a portion of the third feature extends axially rearward of the trailing edge of the second airfoil.

9. The turbine section of claim 1, wherein the pair of airfoils are turbine blades.

10. The turbine section of claim 1, wherein the second feature extends from twenty percent to sixty percent pitch as measured from the second side of the first airfoil and the third feature extends from sixty percent to one-hundred percent pitch as measured from the second side of the first airfoil.

11. The turbine section of claim 1, wherein at least one of the first feature, the second feature, or the third feature includes a flat portion along the first depression, the first peak, or the second depression, respectively.

12. A gas turbine engine comprising:

a variable speed power turbine section;

an annular turbine stage;

a plurality of airfoils within the annular turbine stage and each having a first side, a second side, a leading edge, a trailing edge, the plurality of airfoils having a first airfoil and a second airfoil; and an endwall extending between the second side of the first airfoil and the first side of the second airfoil, the endwall comprising:

a first feature adjacent the second side of the first airfoil between the leading edge and the trailing edge, the first feature spanning twenty percent pitch and having a first depression with a first maximum depression located only between twenty percent and sixty percent of an axial chord length of the first airfoil;

a second feature adjacent the first feature between the leading edge and the trailing edge of the first airfoil, the second feature spanning forty percent pitch and having a first peak with a maximum height located only between thirty-five percent and forty-five of the axial chord length of the first airfoil; and a third feature adjacent the second feature and first side of the second airfoil between the leading edge and the trailing edge, the third feature spanning forty percent pitch and having a second depression with a second maximum depression located only between thirty percent and sixty percent of an axial chord length of the second airfoil.

13. The gas turbine engine of claim 12, wherein the plurality of airfoils are incident tolerant airfoils.

14. The gas turbine engine of claim 12, wherein the first side of each of the plurality of airfoils is a suction side and the second side of each of the plurality of airfoils is a pressure side.

15. The gas turbine engine of claim 12, wherein the first maximum depression is located between thirty-five and forty-five percent of the axial chord length of the first airfoil.

16. The gas turbine engine of claim 12, wherein the second maximum depression is located between forty-five and fifty-five percent of the axial chord length of the second airfoil.

17. The gas turbine engine of claim 12, wherein the endwall extends between an inner diameter of the plurality of airfoils.

18. The gas turbine engine of claim 12, wherein at least a portion of the third feature extends axially rearward of the trailing edge of the second airfoil.

19. The gas turbine engine of claim 12, wherein the plurality of airfoils comprise a turbine rotor.

20. The gas turbine engine of claim 12, wherein at least one of the first feature, the second feature, or the third feature includes a flat portion along an adjacent one of the first feature, the second feature, or the third feature.

* * * * *